United States Patent [19]

Fogel et al.

[11] Patent Number: 4,506,397

[45] Date of Patent: Mar. 26, 1985

[54] WATERBED CONSTRUCTION

[75] Inventors: Isaac Fogel, Silver Spring; Donald W. Keefer, Pasadena, both of Md.

[73] Assignee: Classic Corporation, Jessup, Md.

[21] Appl. No.: 481,248

[22] Filed: Apr. 1, 1983

[51] Int. Cl.[3] ..... A47C 27/08

[52] U.S. Cl. ..... 5/451; 5/460

[58] Field of Search ..... 5/451, 450, 449, 400, 5/460, 474, 401

[56] References Cited

U.S. PATENT DOCUMENTS 4,186,452 2/1980 Underwood ..... 5/400

4,389,741 6/1983 Larson ..... 5/460

OTHER PUBLICATIONS

"Waterworth 131" Trade Brochure Available from Waterworth-15223 Grevillea, Lawndale, Calif. 90260, 1981.

"Naturalizer 2000" A Trade Brochure ©1982 by Land and Sky Mfg. Inc., P.O. Box 2754, Lincoln, Neb. 68501.

*Primary Examiner*—Alexander Grosz

*Attorney, Agent, or Firm*—Finnegan, Henderson, Farabow, Garrett & Dunner

[57] ABSTRACT

A waterbed comprising a foundation having a rigid horizontally extending base and a rigid support member of substantially rectangular cross section fixed on the periphery of the upper surface of the base and substantially laterally completely enclosing a space on the base; a fluid-filled mattress of greater height than the height of the support member resting on the base in the space within the support member; and an annular cushion interlocked between the sides of the mattress and the support member. The annular cushion includes an upper portion resting on the top surface of the support member, a lower portion resting on the base and against the interior face of the support member, and an integral flexible connection between the upper and lower portions for enabling the upper portion to be pivoted away from the top surface of the support member for insertion of the edge of bedclothes therebetween. In a preferred embodiment, the annular cushion includes a restraining member of L-shaped cross section secured to the upper and lower portions across the flexible connection.

16 Claims, 3 Drawing Figures

WATERBED CONSTRUCTION

BACKGROUND OF THE INVENTION

1. Field of the Invention

This invention relates generally to the field of fluid-filled beds and more specifically to a fluid-filled bed having a thickness, width and length comparable to conventional single, double, queen, and king-sized foundations and innerspring mattresses.

2. Description of the Prior Art

Beds utilizing fluid-filled mattresses, commonly referred to as waterbeds, have become quite useful and popular items in recent years. Waterbeds have evolved from relatively simple arrangements consisting of water-filled bladders supported and confined by bulky, solid, peripheral support frames to waterbed mattress and foundation combinations having the same general size and appearance as a conventional innerspring mattress and foundation set. Such arrangements are desirable in that they are not only pleasant in appearance but also allow for use of standard bedclothes such as mattress covers and fitted sheets. Such a waterbed mattress and foundation is described in U.S. Pat. No. 4,145,781 issued to Autrey et al.

However, in Autrey et al., the waterbed mattress and foundation combination requires a vertical, rigid rectangular restraining member substantially the same height as the fluid filled mattress and adjacent to the mattress to provide lateral support for the water in the mattress. The vertical, rigid restraining member must be substantially the same height of the mattress to preclude undesirable pinching of the mattress against the upper surface of the rigid restraining member and the resulting fatigue on the mattress. While the Autrey et al. restraining member's thin top edge is capped with foam cushioning, the restraining member is readily detectable by one getting into or out of the bed, sitting on the bedside, or lying on the bed in the area of the the mattress edge. This problem causes considerable discomfort to anyone using the bed. The Autrey et al. waterbed combination also requires on-site assembly with its inherent potential for misalignment, missing parts, and other problems and improper installation. Thus, while the waterbed combination of Autrey et al. has certain advantages, it also has disadvantages.

From the foregoing considerations, it should be apparent that there is a great need for an improved fluid-filled bed configured to have the same general size and appearance as a conventional innerspring mattress and foundation set which does not have the vertical, rigid restraining member to interfere with the comfort of using the waterbed and which requires no on-site assembly whatsoever except to fill the pre-positioned, factory provided mattress or mattresses with water.

It is, thus, a general object of the present invention to provide a new and improved waterbed having the same general size and appearance as that of a conventional innerspring mattress and foundation set.

Another object of the invention is to give sufficient lateral, peripheral support to the fluid-filled mattress of a waterbed without discomfort to one who gets into or out of the bed or sits or lies upon the waterbed.

A further object of the invention is to eliminate on-site assembly of the waterbed.

Still another object of the invention to allow interlocking between the top annular cushion and the foundation of the waterbed.

Another object of the invention is to allow pivoting of the upper portion of the top annular cushion from the foundation for insertion of the edge of bedclothes therebetween.

Yet another object of the present invention is to increase user comfort by allowing a full nine inch (3.5 cm.) fill of the fluid-filled mattress.

A further object of the invention is to present adequate peripheral, lateral support to the fluid-filled mattress at the area where hydrostatic pressure is large.

Other objects and features of the present invention will become apparent herein with reference to the accompanying drawings and detailed description of the invention.

SUMMARY OF THE INVENTION

To achieve the foregoing objects and in accordance with the purpose of the invention, as embodied and broadly described herein, a waterbed comprises a foundation having a rigid horizontally extending base and a rigid support member of substantially rectangular cross section fixed on the periphery of the upper surface of the base and substantially laterally completely enclosing a space on the base; a fluid-filled mattress of greater height than the height of the support member resting on the base in the space within the support member; and an annular cushion interlocked between the sides of the mattress and the support member, the cushion including an upper portion resting on the top surface of the support member, a lower portion resting on the base portion and against the interior face of the support member, and an integral flexible connection between the upper and lower portions for enabling the upper portion to be pivoted away from the top surface of the support member for insertion of the edge of bedclothes therebetween. In a preferred embodiment, the annular cushion includes a restraining member of L-shaped cross section secured to the upper and lower portions across the flexible connection and overlying at least a portion of the top surface and interior face of the support member to prevent bowing of the annular cushion by hydrostatic pressure exerted thereon by the fluid-filled mattress.

BRIEF DESCRIPTION OF THE DRAWINGS

The accompanying drawings, which are incorporated in and constitute a part of this specification, illustrate a preferred embodiment of the invention and, together with the description, serve to explain the principles of the invention.

Of the drawings.

DESCRIPTION OF THE PREFERRED EMBODIMENT

Reference will now be made in detail to the preferred embodiment of the invention, an example of which is illustrated in the accompanying drawings.

Figure 1:
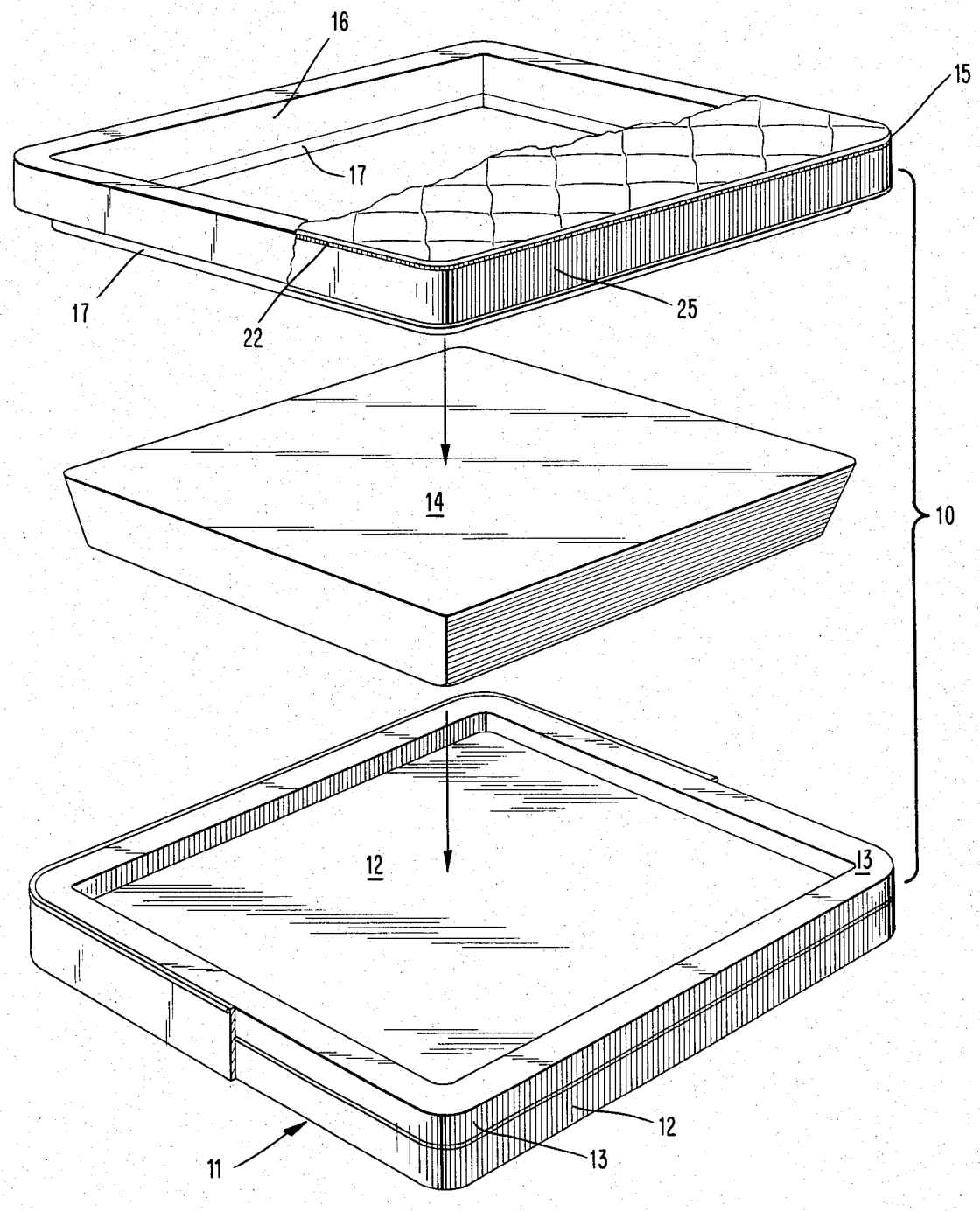
FIG. 1 is a exploded perspective view, partly broken away showing the waterbed according to the invention.
Figure 2:
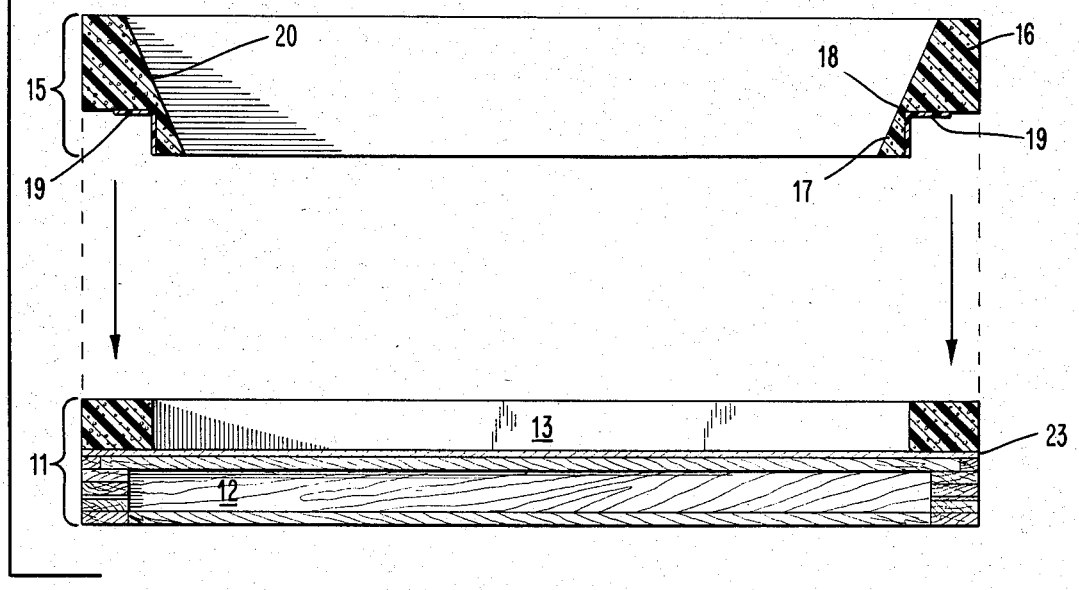
FIG. 2 is an exploded sectional view of the waterbed of FIG. 1.
Figure 3:
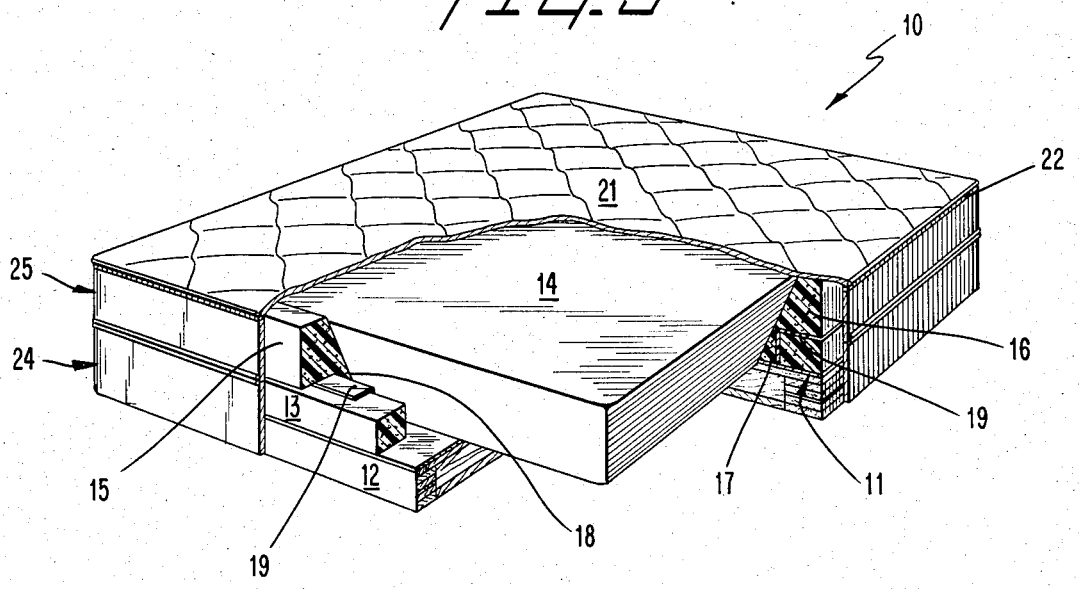
FIG. 3 is an enlarged fragmentary sectional view of the waterbed of FIG. 1.

Referring now to the drawings wherein like reference characters designate like parts in the drawings, there are shown in FIGS. 1–3, which illustrates a preferred embodiment, a waterbed, generally referenced as 10, comprising a foundation 11, a fluid-filled mattress 14 (not shown in FIG. 2), and an annular cushion 15. Foundation 11 has a rigid horizontally extending base 12 and a rigid support member 13 of substantially rectangular cross section fixed on the periphery of the upper surface of base 12 and substantially laterally completely enclosing a space on base 12. In a preferred embodiment, base 12 is made of wood or other rigid material suitable for horizontally supporting a fluid-filled mattress. Support member 13 is fabricated of a rigid material such as wood or preferably expanded polystyrene and is fixed to the upper surface of base 12 by glue, double-faced adhesive tape, brads, screws, or other suitable securing means.

The length and width of both foundation 11 and annular cushion 15 are comparable to the length and width of conventional single, double, queen, or king-sized foundations and innerspring mattresses, as desired. Furthermore, as discussed below, the combined thickness of foundation 11 and annular cushion 15 is comparable to that of a conventional foundation and innerspring mattress set. Of course, however, foundation 11, annular cushion 15, and mattress 14 can be of any other desired shape.

Annular cushion 15 is made of flexible material, such as a flexible plastic foam, preferably urethane foam. Annular cushion 15 includes an upper portion 16 resting on the top surface of support member 13, lower portion 17 resting on base 12 and against the interior face of support member 13, and an integral flexible connection 18 between the upper and lower portions for enabling upper portion 16 to be pivoted away from the top surface of support member 13, when mattress 14 is in place, for insertion of the edge of bedclothes (not shown) therebetween.

As shown in FIG. 3, when mattress 14 is in position and filled, annular cushion 15 is interlocked between the sides of mattress 14 and support member 13 by the positioned relationship of lower portion 17, support member 13, and mattress 14.

In a preferred embodiment, annular cushion 15 has a restraining member 19 and a sloping interior wall 20 so that the annular cushion cooperates with support member 13 to provide lateral support for mattress 14 without interfering with the comfort of the bed user sitting on the bedside, lying on the bed, or getting into or out of the bed. Preferably, support member 13 has a height approximately one-third of the height of fluid-filled mattress 14 which is described below. Being so, lateral support is given to mattress 14 where hydrostatic pressure is large.

Specifically, restraining member 19 is L-shaped in cross section and secured to upper portion 16 and lower portion 17 of annular cushion 15 across flexible connection 18 as shown in FIG. 3. Restraining member 19 overlies at least a portion of the top surface and interior face of support member 13 to prevent bowing of annular cushion 15 by hydrostatic pressure exerted thereon by fluid-filled mattress 14. Restraining member 19 is preferably made of high impact polystyrene or other like strong but semi-flexible material and is adhesively bonded to the surfaces of upper portion 16 and lower portion 17 of annular cushion 15.

Restraining member 19 can be, but need not be, one continuous piece. Preferably, it is made of four pieces, one for each side of annular cushion 15.

Waterbed 10 includes a fluid-filled mattress 14 of greater height than the height of support member 13. Mattress 14 rests on base 12 in the space defined by support member 13 and lower portion 17 of annular cushion 15 when annular cushion 15 is in place. Mattress 14 is fabricated of a flexible material such as 20–24 mil vinyl. Additionally, mattress 14 may consist of a single bladder or two bladders in side-by-side relationship in the space defined above.

Preferably, mattress 14 has a depth of approximately nine inches (3.5 cm.) when filled for comfort. Furthermore, the combined height of an external vertical side of upper portion 16 of annular cushion 15 and an external vertical side of support member 13 approximates the height of fluid-filled mattress 14.

To give waterbed 10 the appearance of a conventional innerspring mattress and foundation set, the external vertical side of upper portion 16 of annular cushion 15 has a weight approximately the same as a conventional innerspring mattress. Additionally, waterbed 10 includes top cover 21 secured to annular cushion 15 and overlying the top of annular cushion 15 and fluid-filled mattress 14. In a preferred embodiment, at least a portion of top cover 21 is separable from annular cushion 15 for access to fluid-filled mattress 14 when annular cushion 15 rests on and is interlocked with foundation 11. Connecting means such as a zipper 22 or the like may be used to enable cover 21 to be separated from annular cushion 15.

External vertical side 23 of foundation 11 has a height approximately the same as a conventional foundation for a conventional innerspring mattress and is tailored with a covering material 24 to give the foundation an outward appearance of a conventional foundation. Similarly, the external vertical sides and the top cover of annular cushion 15 are tailored with a covering material 25 to give an outward appearance of a conventional innerspring mattress.

In use, waterbed 10 is assembled at its manufacturing site by placing annular cushion 15 in overlying relationship with foundation 11 and placing unfilled mattress 14 in the cavity defined.

To set waterbed 10 up for operation, foundation 11 is simply placed on a suitable support, if desired, which is a conventional bedframe, and top cover 21 is partially moved back by unzipping zipper 22 to expose a fill/-drain valve (not shown). Mattress 14 is then filled with fluid to a desired level and top cover 21 is reattached to annular cushion 15.

When mattress 14 is filled, lateral support for mattress 14 is provided by annular cushion 15, support member 13, and restraining member 19. Furthermore, annular cushion 15 is interlocked between the sides of mattress 14 and support member 13 due to the positioning of lower portion 17 of annular cushion 15. However, with the integral flexible connection 18 between upper and lower portions of annular cushion 15 and with the flexibility provided in restraining member 19, upper portion is easily pivoted away from the top surface of support member 13 for insertion of the edge of bedclothing therebetween to facilitate making up of waterbed 10 with conventional fitted or flat bedclothing.

Waterbed 10 can then be made up and used in the manner of a conventional bed. Importantly, the user of waterbed 10 enjoys the benefits of a waterbed without discomfort resulting (1) from the use of rigid lateral restraining members at the top surface and (2) from use of a fluid-filled mattress having less than a depth of about nine inches (3.5 cm.).

Waterbed 10 may also have a safety liner (not shown), made preferably of 12-mil vinyl, which lies over the upper and lower portions of annular cushion 15 and passes under fluid-filled mattress 14 to act as a safety reservoir for any fluid which should accidentally leak from mattress 14. Additionally, waterbed 10 may be provided with a heating element (not shown) for each fluid-filled mattress used to regulate the temperature of the fluid in each mattress for additional comfort.

Obviously, many modifications and variations of the present invention are possible in light of the above teachings. It is, therefore, to be understand, that within the scope of the appended claims, the invention may be practiced otherwise than as specifically described.

What is claimed is:

1. A waterbed comprising:

a foundation having a rigid horizontally extending base and a rigid support member of subtantially rectangular cross section fixed on the periphery of the upper surface of said base and substantially laterally completely enclosing a space on said base;

a fluid-filled mattress of greater height than the height of said support member resting on said base in said space within said support member; and an annular cushion interlocked between the sides of said mattress and said support member, said cushion including an upper portion resting on the top surface of said support member, a lower portion resting on said base and against the interior face of said support member, an integral flexible connection between said upper and lower portions for enabling said upper portion to be pivoted away from the top surface of said support member for insertion of the edge of bedclothes therebetween, and a restraining member of L-shaped cross section secured to said upper and lower portions across said flexible connection and overlying at least a portion of said top surface and interior face of said support member to prevent bowing of said annular cushion by hydrostatic pressure exerted thereon by said fluid-filled mattress.

2. The waterbed of claim 1 wherein the external vertical sides of said upper portion have a height approximately the same as a conventional innerspring mattress.

3. The waterbed of claim 1 also including a top cover secured to said annular cushion and overlying the top of said annular cushion and said mattress.

4. The waterbed of claim 3 wherein the external vertical sides of said foundation have a covering material to give the foundation an outward appearance of a conventional foundation for a conventional innerspring mattress, and the external vertical sides and the top cover of said annular cushion have a covering material to give an outward appearance of a conventional innerspring mattress.

5. The waterbed of claim 3 wherein at least a portion of said covering material for the top is separable from said annular cushion for access to said fluid-filled mattress.

6. The waterbed of claim 1 wherein said annular cushion has a sloping interior wall, and wherein said annular cushion, said support member, and said restraining member provide lateral support for said fluid filled mattress.

7. The waterbed of claim 1 wherein said fluid-filled mattress has a depth of approximately nine inches.

8. The waterbed of claim 1 wherein said support member has a height approximately one-third of the height of said fluid-filled mattress.

9. The waterbed of claim 1 wherein the combined height of the external vertical side of said annular cushion and the external vertical side of said support member approximates the height of said fluid-filled mattress.

10. A framework for confining a fluid-filled mattress of a waterbed, the framework comprising:

a fixed, rigid support member of substantially rectangular cross section for extending around the lower periphery of the fluid-filled mattress; and an annular cushion having an upper portion resting on the top surface of said support member, a lower portion resting against the interior face of said support member, an integral flexible connection between said upper and lower portions for interlocking said annular cushion between the sides of mattress and said support member and for enabling said upper portion to be pivoted away from the top surface of said support member for insertion of the edge of bedclothes therebetween when said fluid-filled mattress is in use, and a restraining member of L-shaped cross section secured to said upper and lower portions and overlapping part of said support member to prevent bowing of said annular cushion by hydrostatic pressure exerted thereon by said fluid-filled mattress.

11. The framework of claim 10 wherein the external vertical sides of said upper portion have a height approximately the same as a conventional innerspring mattress.

12. The framework of claim 11 also including a top cover secured to said annular cushion and overlying the top of said cushion and the mattress.

13. The framework of claim 12 wherein at least a portion of said top cover is separable from said annular cushion for access to the fluid-filled mattress.

14. The framework of claim 12 wherein said top cover and the external vertical sides of said upper portion having a covering material to give an outward appearance of a conventional innerspring mattress and the external vertical sides of said support member have a covering material to give an outward appearance of a conventional foundation.

15. The framework of claim 11 wherein the combined height of an external vertical side of said upper portion and the external vertical side of said support member approximates the height of the fluid-filled mattress.

16. The framework of claim 15 wherein said combined height is approximately nine inches.

* * * * *